US005533913A

United States Patent [19]

Boehm et al.

[11] Patent Number: 5,533,913

[45] Date of Patent: Jul. 9, 1996

[54] ELECTRICAL CONNECTOR INCLUDING MOLDED PLASTIC BODY

[75] Inventors: William J. Boehm; Gunter E. Dinkel, both of Hamilton, Ohio

[73] Assignee: Connector Manufacturing Company, Hamilton, Ohio

[21] Appl. No.: 261,665

[22] Filed: Jun. 17, 1994

[51] Int. Cl.[6] ..... H01R 4/36

[52] U.S. Cl. ..... 439/810; 439/931

[58] Field of Search ..... 439/86, 933, 810–812, 439/814, 931

[56] References Cited

U.S. PATENT DOCUMENTS

| | | | |
|---|---|---|---|
| 3,452,317 | 6/1969 | Carlson | 439/810 |
| 3,836,941 | 9/1974 | Izraeli | 439/810 |
| 4,330,168 | 5/1982 | Arnold | 439/877 |
| 4,838,799 | 6/1989 | Tonooka | 439/86 |
| 5,005,104 | 4/1991 | Grunert et al. | 439/810 |
| 5,030,131 | 7/1991 | Boehm | 439/387 |
| 5,206,789 | 4/1993 | Barbry | 439/810 |
| 5,228,871 | 7/1993 | Goodman | 439/931 |

OTHER PUBLICATIONS

Connector Manufacturing Company—pp. 25 and 30.

*Primary Examiner*—Gary F. Paumen
*Attorney, Agent, or Firm*—Biebel & French

[57] ABSTRACT

An electrical connector for terminating the end of an electrically conductive wire is formed from two principal components, namely a body member preferably constructed of an electrically insulating material, and an elongated, electrically conductive strip of metal or electrically conductive member. The body member is preferably made of plastic and includes two openings: a first opening for receiving the electrically conductive wire and a second threaded opening for receiving a set screw which, when tightened, secures the electrically conductive wire in said first opening and to the conductive metal strip. The body member may be formed by extrusion or molding, and may be of any color to provide easy identification. The electrically conductive member may be flat or bent according to its particular intended use, and is provided with a mounting aperture for securing the connector to a mounting surface on an electrical bus.

7 Claims, 4 Drawing Sheets

ELECTRICAL CONNECTOR INCLUDING MOLDED PLASTIC BODY

BACKGROUND OF THE INVENTION

This invention relates to an improved electrical terminal connector of the type that is used between the end of a conductor or wire and a bus or another device to which the connector may be connected.

A typical terminal connector is formed from an extruded aluminum bar and includes a body portion provided with an opening into which the end of the conductor or wire is inserted, a set screw to hold the wire in place, and an elongated tang extending from the body that is provided with an opening through which a mounting screw may be inserted to hold the connector in electrical and mechanical contact with a bus bar or another electrical component. One such prior art connector is shown in U.S. Pat. No. 5,030,131.

Since the terminal connector is cut from an extruded bar, the body member and the tang are usually the same width. The openings in the body member for the wire is separately machined as is the openings and threads for the set screw.

SUMMARY OF THE INVENTION

The present invention is directed to a solderless terminal connector for joining an electrical conductor or wire to a bus bar or similar electrical component. In particular, the terminal connector of the present invention includes a body member that may be formed from a block of electrically insulating material, such as plastic, that includes an opening for accepting the end of the wire and also an elongated electrically conductive member, and another opening that is threaded to receive a set screw to secure the wire in mechanical and electrical contact with the conductive member.

When an electrically insulating material is used for the body member, it provides many advantages in a terminal connector. For example, the electrically conductive member can be made narrower than the body member, thus allowing the body members of adjacent connectors to be placed in close proximity, even touching one another, without causing an electrical short circuit; the same body members may be used with different configurations of conductive members, that is, where some are planar and others bent or otherwise configured to suit a particular application.

Forming or machining the electrically conductive member separate from the body member adds flexibility to the manufacture of the connector and permits improved performance without significantly increasing cost.

The use of plastic as the electrically insulating material of the body member allows different colors to be employed, when desired, to identify different electrical functions or different current ratings.

A plastic body member is easily machined as compared to a metal connector, thus reducing cost. In prior art terminal connectors, the corners of the body member are normally trimmed to reduce the tendency to cut wires or cables, but that operation is not necessary with a plastic component.

Also, the use of an electrically insulating material reduces the amount of metal needed for an effective terminal connector, thus making a connector constructed according to this invention significantly lighter and less expensive than prior art connectors.

It has also been found that the set screw that secures the wire in the connector does not have the same tendency to stick in a plastic body, which is sometimes a problem with metal bodies due to corrosion. Further, plastic body members have stable dimensions and therefore the screws do not tend to loosen as the connector is subjected to varying temperatures.

It is therefore an object of this invention to provide an improved electrical connector comprising an electrically conductive strip and a body member made from an electrically insulating material, such as plastic.

It is a further object of this invention to provide an electrical connector of the type described which is light weight, uses less metal than prior art devices, and which can be made of various colors for easy identification.

It is still another object of this invention to provide an electrical connector for terminating the end of an electrically conductive wire comprising a body member preferably constructed of an electrically insulating material having formed therein a first opening for receiving the electrically conductive wire and a second threaded opening for receiving a get screw which, when tightened, secures the electrically conductive wire in said first opening, and an elongated, electrically conductive strip of metal having a first end thereof which extends into said opening in said body member and which has an upper surface for engaging the electrically conductive wire, and a second end thereof that includes a lower surface for electrically engaging a mounting surface.

It is a further object of this invention to provide a method of making an electrical connector including the steps of forming an elongated electrically conductive member with a neck end and a terminal end, forming an block member with at least one opening for receiving both the neck end of the electrically conductive member and a wire, and another opening for a set screw to hold the wire securely in place and in electrical contact with the neck end, and combining the electrically conductive member and the block member to form a integral connector.

Other objects and advantages of the invention will be apparent from the following description, the accompanying drawings and the appended claims.

DESCRIPTION OF THE PREFERRED EMBODIMENT

Figure 1:
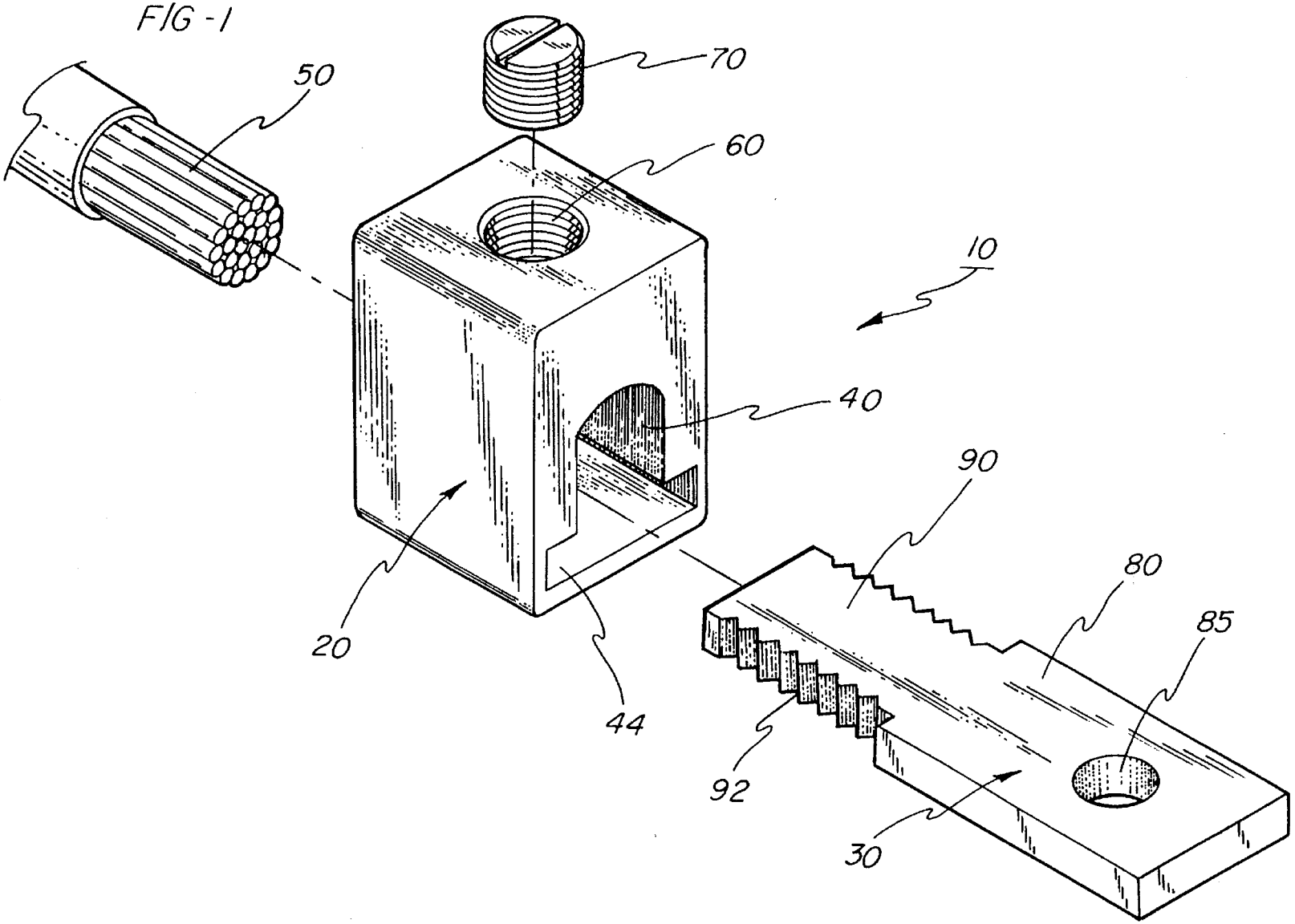
FIG. 1 is an exploded perspective view of the connector of the present invention showing an electrically insulating body member or component and a electrically conductive member.

Referring now to the drawings, and particularly to FIG. 1, an electrical connector 10 is shown as including two major components, namely a body member 20 and an electrically conductive member 30.

The body member 20 is preferably formed from a solid block of an electrically insulating plastic material. Several suitable materials are available for use, such as Torlon™ 42031 polymer manufactured by Amoco Performance Products; Zytel™ FR-50 glass reinforced nylon resin and Rynite™ FR-530 or RE 7909 thermoplastic polyester resins from Dupont; Ultem™ 2300 polyetherimide resin or Ultem D4302 polyetherimide glass reinforced resin from General Electric; or Celanese® Nylon 1503 or 1603 glass reinforced nylon from Hoechst Celanese.

Figure 3:
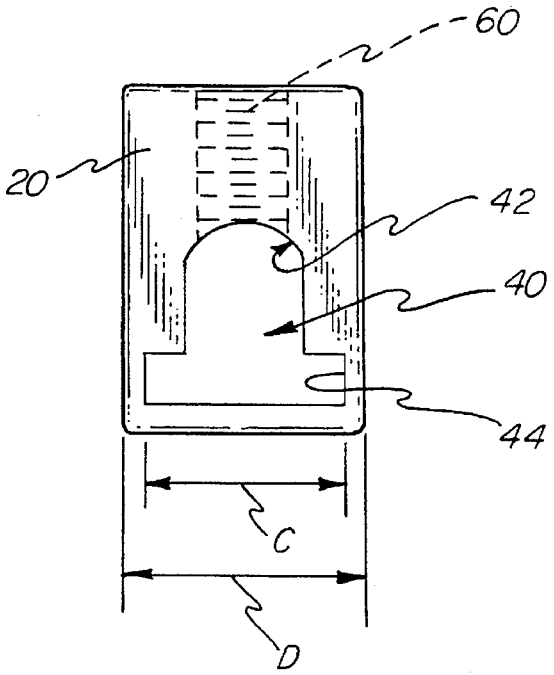
FIG. 3 is an end elevational view of the body member shown in FIG. 1.

Two openings are formed in the body member 20. The first is opening 40, which extends longitudinally through the block, as shown in FIG. 1. This opening, as shown in FIG. 3, includes a generally circular portion 42 for receiving a wire 50 which is to be terminated in the connector 10, and a rectangular portion or slot 44 which receives the electrically conductive member 30. At least opening 42 extends entirely through the body member 20 although in practice both openings 42 and 44 will extend completely through the body member.

The second opening 60 is perpendicular to the opening 40 and is preferably formed in the top surface of the body member 20. Opening 60 is threaded to receive a clamping or set screw 70. The set screw, when tightened, will hold the wire 50 securely in place within the connector 10 and against the conductive member 30.

Figure 6:
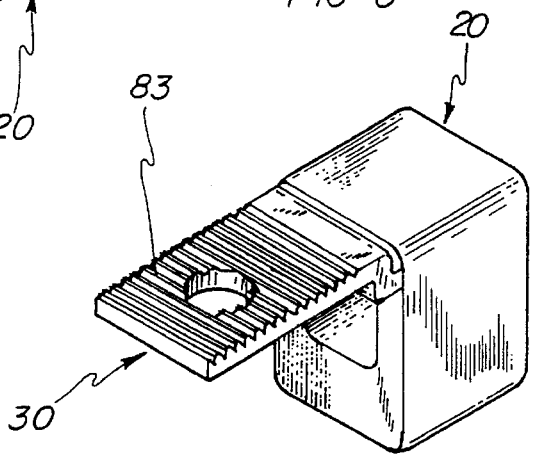
FIG. 6 is a underneath perspective view of an assembled connector constructed according to either Figs. 1 or 5.
Figure 8:
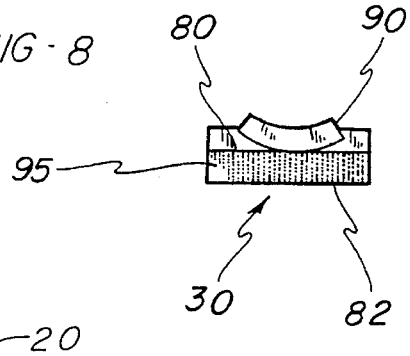
FIG. 8 is an end view of the electrically conductive member shown in FIG. 1.

The member 30 is an electrically conductive, elongated strip of metal, typically aluminum, which includes an upper surface 80 for engaging the wire 50 inside the body member 20 and a lower surface 82 that is intended to contact the mounting surface of an electrical bus. If desired, the lower surface 82 of the electrically conductive member may be provided with notches 83 (FIG. 6) of the type shown in U.S. Pat. No. 5,030,131. A mounting aperture 85 is formed in the central part of the electrically conductive member 30, and a mounting screw (not shown) is placed through the aperture to attach the electrically conductive member securely to the conductor or bus.

Figure 4:
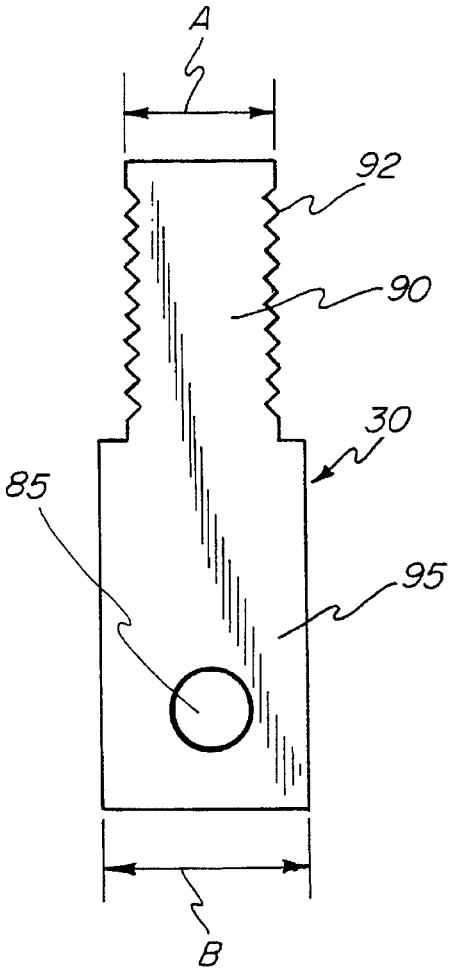
FIG. 4 is a plan view of an electrically conductive member shown in FIG. 1.

As shown in FIGS. 1 and 4, the electrically 10 conductive member 30 is preferably formed from a sheet of metal and is provided with a first end or neck portion 90 having a width A. The outer edges of the neck portion may be notched, as at 92, to assist in holding the member 30 securely within the body member 20. The width A of the neck 90 is approximately the same as width C (FIG. 3) of the slot 44 in the body member 20. The width A of the neck 90 is sufficient to engage fully any wire 50 that may be inserted into the opening 40.

The electrically conductive member 30 also includes a second or terminal end 95 having a width B, which is typically equal to or smaller than the outside dimension of the body member 20 or width D. By making the terminal end 95 smaller, connectors 10 may be positioned with their body members 20 touching while maintaining electrical isolation of their conductive components.

Figure 2:
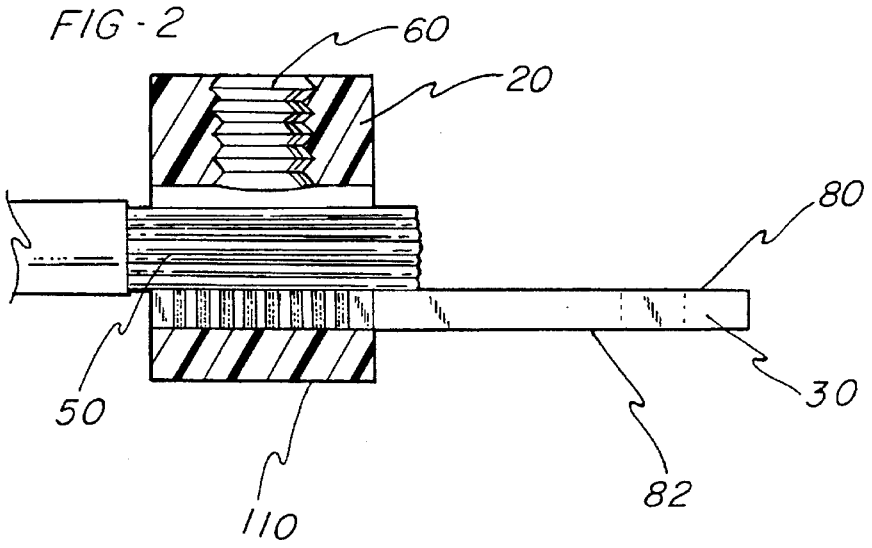
FIG. 2 is a side elevational view of the connector of the present invention showing the body member is cross section and a wire or conductor installed, but not secured in place.
Figure 5:
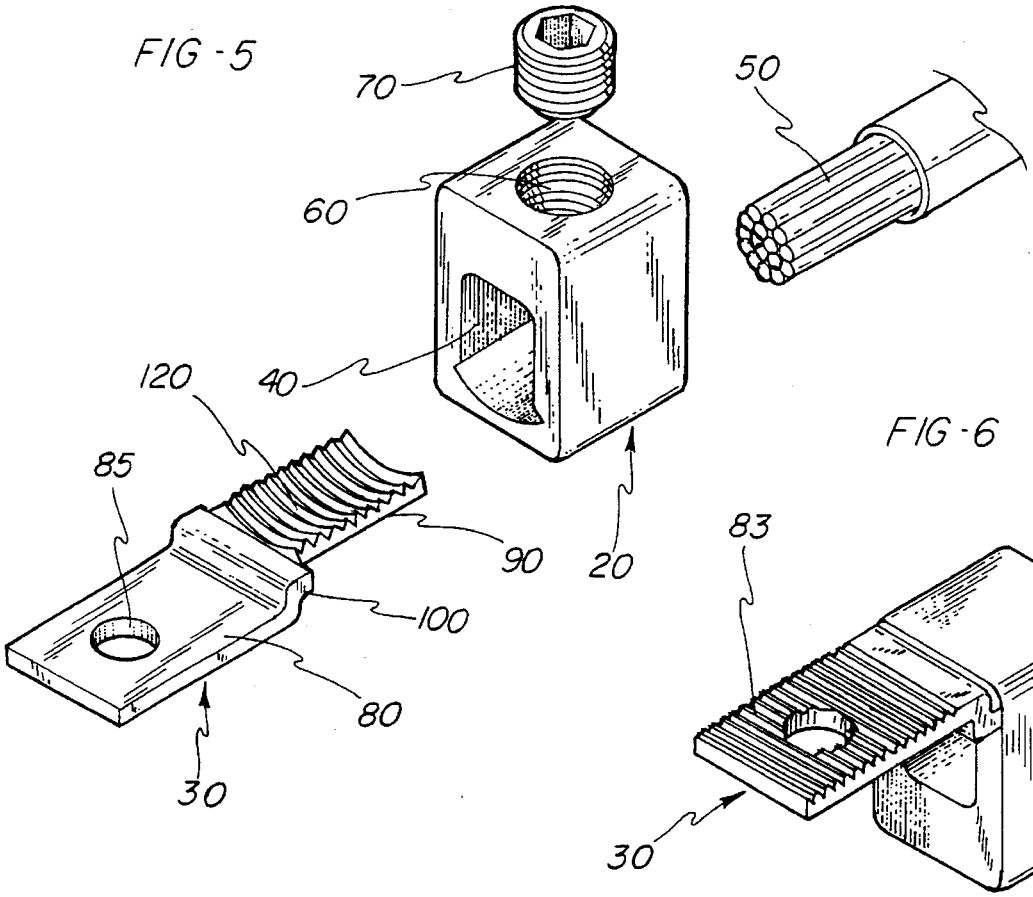
FIG. 5 is an exploded perspective view of another embodiment of the invention.
Figure 7:
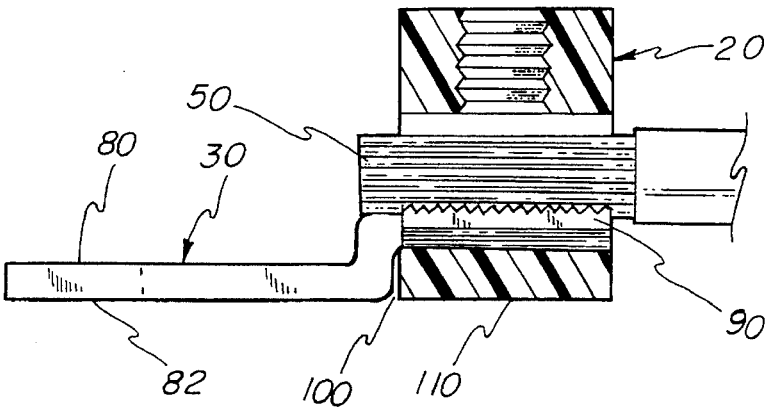
FIG. 7 is a side elevational view of the connector of FIG. 5 showing the body member is cross section and a wire or conductor installed, but not secured in place.
Figure 10:
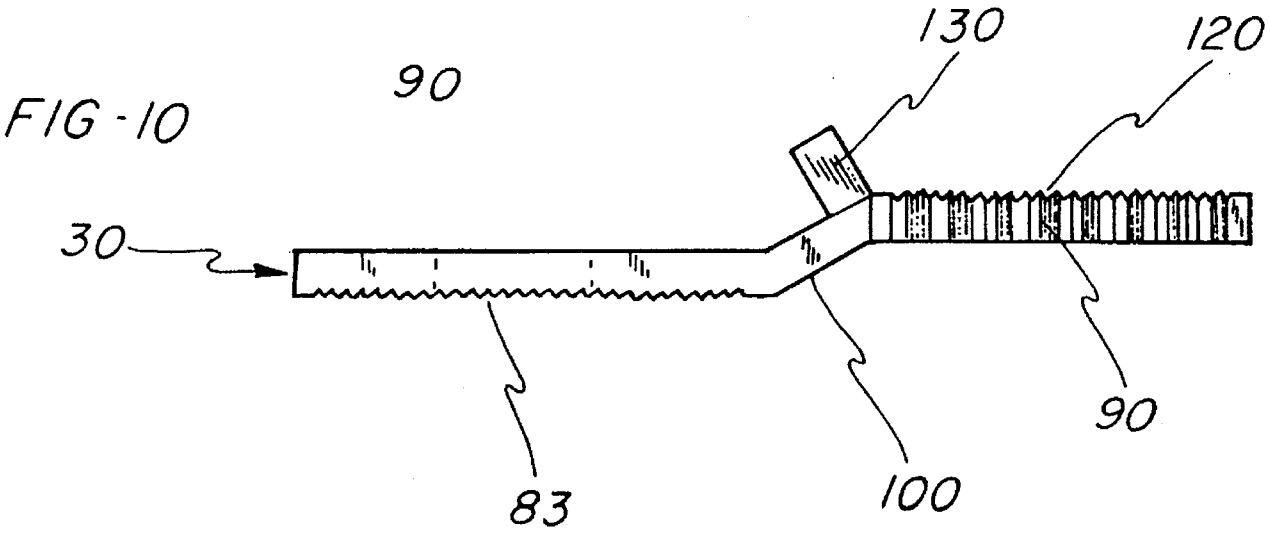
FIG. 10 is a side elevational view of the electrically conductive connector of FIG. 9.

The electrically conductive member 30 may be formed straight, as illustrated in FIGS. 1 and 2) or bent or provided with a step at 100 (as shown in FIGS. 5, 7 and 10) to place the lower surface 82 of the electrically conductive member 30 at the same elevation as the lower surface 110 of the body member 20.

The member 30 may also be provided with notches or scoring 120 on the neck portion 90 (as shown in Fig. 5) for gripping the wire 50 once the set screw 70 has been tightened.

Figure 9:
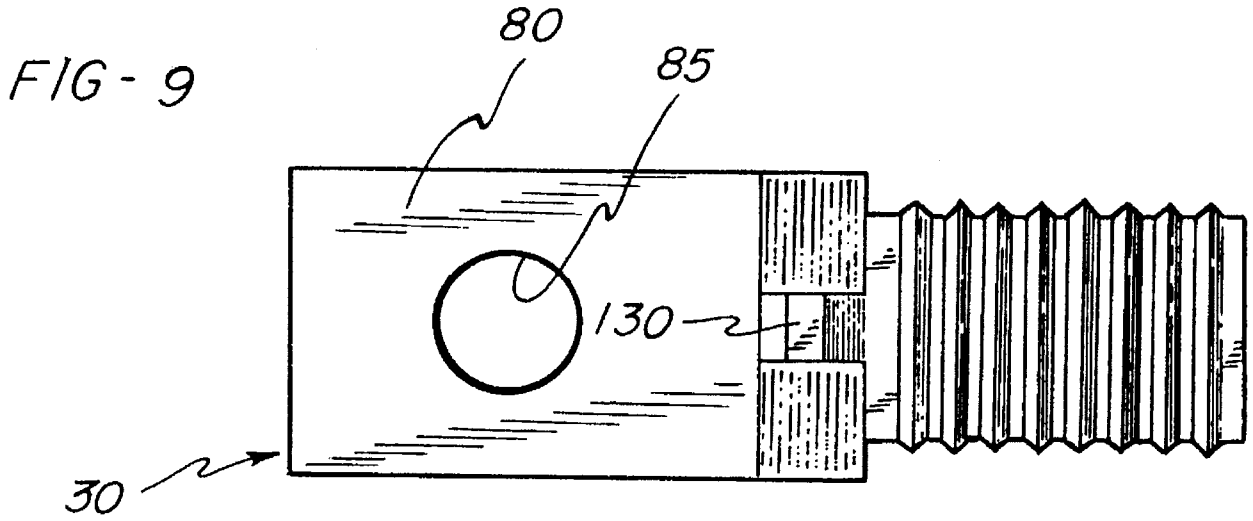
FIG. 9 is a top plan view of another embodiment of an electrically conductive member that may be installed in the body member of FIG. 1.

As shown in FIGS. 5–8, the neck 90 of the conductive member 30 may be curved with a radius generally to conform to the radius of the wire 50. 0f course, various sizes of wires 50 may be inserted into the connector, but generally a connector 10 is designed primarily for one size wire, and having the radius of the connector matching the contour of the wire improves the surface area of contact, thus improving the electrical connection itself. FIGS. 9 and 10 show another form of electrically conductive member 30 that includes a tab 130 extending upwardly to form a stop for the wire 50. The tab 130 is merely cut from the center section of the member 30 in the vicinity of the bend 100, and bent upwardly as shown in FIG. 10. The member 30 may also include notches 83 on the bottom surface 82 of its terminal end 95 and wire engaging notches 120 on the neck 90. The neck may be either flat, as shown, or curved, as illustrated in FIG. 5.

The member 30, since it is formed separately from the body 20, may be stamped or machined before it is assembled as part of the complete connector 10. Forming the neck 90 with a curved wire engaging surface, and with notches, would be an expensive machining operation if the connector were manufactured from a single metal block.

The body 20 may be formed separately with the member 30 installed into the body, or the body may be molded around the member 30 to form an essentially integral component.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. An electrical connector for terminating the end of an electrically conductive wire comprising:

a body member constructed of an electrically insulating material not having an electrically conductive coating and having formed therein a first opening for receiving the electrically conductive wire and a second threaded opening for receiving a set screw which, when tightened, secures the electrically conductive wire in said first opening, and an elongated, electrically conductive strip of metal having a first end thereof which extends into said opening in said body member and which has an upper surface for engaging the electrically conductive wire, and a second end thereof that includes a lower surface for electrically engaging a mounting surface.

2. An electrical connector for terminating the end of an electrically conductive wire comprising:

an elongated, electrically conductive strip of metal having a first end thereof for receiving on one surface thereof the electrically conductive wire, and a second end thereof with the other surface thereof for electrically engaging a mounting surface, and a body member constructed of an electrically insulating material not having an electrically conductive coating and having formed therein a first opening for receiving both said first end of said elongated strip and the electrically conductive wire and a second, threaded opening for receiving a set screw which, when tightened, secures the electrically conductive wire in said first opening in contact with said first end of said elongated strip.

3. A method of making an electrical connector including the steps of forming an elongated electrically conductive member with a neck end and a terminal end, forming a block member from an electrically insulating material not having an electrically conductive coating with at least one opening for receiving both the neck end of the electrically conductive member and a wire, and another opening for a set screw to hold the wire securely in place and in electrical contact with the neck end, and combining the electrically conductive member and the block member to form a integral connector.

4. The method of claim 3 further including the step of forming the neck member of the electrically conductive member with a radius compatible with the outside surface of the wire.

5. The method of claim 3 further including the step of forming notches in the upper surface of the neck member to improve electrical and mechanical contact with the wire.

6. The method of claim 3 further including the step of forming a wire stop in the electrically conductive member between the neck end and the terminal end.

7. The electrical connector of claim 1 wherein said second end of said electrically conductive strip is narrower than said body member.

* * * * *